US008973627B2

(12) United States Patent
Pynes et al.

(10) Patent No.: US 8,973,627 B2
(45) Date of Patent: Mar. 10, 2015

(54) MODULAR SCARF PURSE

(76) Inventors: Julie Pynes, Carlsbad, CA (US); Jim McCafferty, San Clemente, CA (US); Steve Delacy, Santa Ana, CA (US); Greg Leong, Irvine, CA (US)

( * ) Notice: Subject to any disclaimer, the term of this patent is extended or adjusted under 35 U.S.C. 154(b) by 299 days.

(21) Appl. No.: 13/620,629

(22) Filed: Sep. 14, 2012

(65) Prior Publication Data

US 2013/0068356 A1 Mar. 21, 2013

Related U.S. Application Data

(60) Provisional application No. 61/535,247, filed on Sep. 15, 2011.

(51) Int. Cl.

| | |
|---|---|
| ***A45C 3/08*** | (2006.01) |
| ***A45C 3/00*** | (2006.01) |
| *A45C 13/02* | (2006.01) |

(52) U.S. Cl.

CPC . *A45C 3/08* (2013.01); *A45C 3/001* (2013.01); *A45C 2013/026* (2013.01)

USPC ..... 150/105; 150/130; 150/127; 150/111; 383/4; 383/119

(58) Field of Classification Search

USPC ..... 248/99; 150/105, 130, 127, 111; 383/4, 383/119; 229/87.01

See application file for complete search history.

(56) References Cited

U.S. PATENT DOCUMENTS

| | | | | | |
|---|---|---|---|---|---|
| 1,063,031 | A * | 5/1913 | Henry | 150/105 |
| 2,131,382 | A * | 9/1938 | Lobel | 150/105 |
| 4,156,400 | A * | 5/1979 | Migdal | 119/161 |
| 4,530,533 | A * | 7/1985 | Dieter | 294/214 |
| 4,760,982 | A * | 8/1988 | Cooke | 248/99 |
| 4,792,024 | A * | 12/1988 | Morton et al. | 190/1 |
| 5,027,748 | A * | 7/1991 | Wolak | 119/168 |
| 5,897,084 | A * | 4/1999 | Judge | 248/95 |
| 6,086,022 | A * | 7/2000 | Dalton | 248/99 |
| 6,450,461 | B1 * | 9/2002 | Lohmann | 248/99 |
| 2004/0187988 | A1 * | 9/2004 | Andrews | 150/127 |
| 2009/0283183 | A1 * | 11/2009 | Golan | 150/104 |

* cited by examiner

*Primary Examiner* — Tri Mai

(74) *Attorney, Agent, or Firm* — Marc E. Hankin; Kevin Schraven; Hankin Patent Law, APC

(57) ABSTRACT

The invention is a modular pop-up purse shell, with an optional insert, wherein a rectangular swatch of material is removably attached to the purse shell to create a customized purse.

14 Claims, 9 Drawing Sheets

MODULAR SCARF PURSE

CROSS-REFERENCE TO RELATED APPLICATIONS

This Non-Provisional Patent Application claims priority to Provisional Application No. 61/535,247, titled "MODULAR SCARF PURSE AND A METHOD OF CREATING A MODULAR SCARF PURSE", filed Sep. 15, 2011, by inventors Jim McCafferty, Julie Pynes, Steve Delacy, and Greg Leong, the entire contents of which are hereby incorporated by this reference as though set forth in its entirety.

FIELD OF THE INVENTION

The invention relates to a device, method, and system for creating a modular scarf bag. More particularly, the invention is a modular pop-up purse shell, with one or more optional inserts, wherein a rectangular swatch of cloth is removably attached to the shell to create a customized purse.

BACKGROUND OF THE INVENTION

People have utilized storage devices for transporting various forms of personal items for thousands of years. Examples of such personal carrying devices include backpacks, briefcases, bags, luggage, satchels, infant carriers, purses, and fanny packs. Purses have become an important fashion accessory, which has led to the need to create desirable and fashionable purses.

Unfortunately, just as fast as a fashion trend, or fad, starts, it can just as quickly end. Because fashionable purses are quite expensive, it can be very costly to repeatedly purchase the latest most fashionable purses. This has led to the need for purses with an interchangeable covering. Although various types of interchangeable purses have been manufactured, those purses are limited in that they do not allow the user to quickly, easily, and inexpensively change the purse covering. Moreover, before the present invention, the choice of coverings was limited to those coverings made available by the purse manufacturer.

Thus, what is needed is a purse with a cover that is removably attached to the purse to create a customized purse from any unlimited number of designer covers.

SUMMARY OF THE INVENTION

To minimize the limitations in the prior art, and to minimize other limitations that will become apparent upon reading and understanding the present specification, the present invention discloses a new and useful device, method, and system for creating a cloth or scarf purse.

One embodiment of the invention is a modular purse device comprising: a purse shell; and a swatch of material. The swatch of material is removably attached to the purse shell. Preferably the device includes a purse insert. Preferably, the purse shell has a plurality of holes, wherein the swatch of material is removably attached to the purse shell by tying a plurality of corners of the swatch of material to the plurality of holes of the purse shell. Preferably, the purse shell is comprised of one or more strap connectors.

Another embodiment of the invention is a method of creating a scarf purse, the steps comprising: providing a purse shell; providing a swatch of material; attaching the swatch of material to the purse shell. Preferably the steps may include: inserting a purse insert into the purse shell and/or attaching a strap to the purse shell.

Another embodiment of the invention is a modular purse device comprising: a purse shell; and a swatch of material, such as a scarf. The swatch of material is removeably interconnected to the purse shell. The purse shell comprising a base and a plurality of sides. The plurality of sides have one or more material apertures, such that the swatch of material is removeably interconnected to the purse shell via the one or more material apertures. The plurality of sides have one or more strap connectors. The swatch of material is preferably rectangular or square and has one or more edges. The swatch of material is placed under the base of the purse shell and wrapped around the plurality of sides of the purse shell and tied to the one or more material apertures, such that the swatch of material substantially covers the purse shell and a purse interior cavity is formed. Preferably, the modular purse device may further include a purse insert, wherein the purse insert is placed within the purse interior cavity, such that the purse insert matingly fits within the purse shell. Preferably, the purse insert has a plurality of sides, a base, and a closure portion. Preferably, the plurality of sides and the base of the purse insert are substantially covered by the swatch of material. Preferably, the base of the purse shell has one or more material connectors; and wherein the swatch of material engages with the one or more material connectors such that the swatch of material is interconnected with the base of the purse shell. Preferably, the closure portion of the purse insert comprises two flaps; wherein the two flaps each have one or more connectors; wherein the one or more connectors removeably engage with each other to substantially close the purse insert. Preferably, the purse insert is further comprised of one or more interior pockets; wherein the one or more interior pockets are configured to hold a plurality of contents of a modular purse device. Preferably, the purse includes a strap; wherein the strap is removeably connected to the one or more strap connectors, such that the modular purse device may be carried by a user via the strap.

Another embodiment of the invention is a modular purse device comprising: a purse shell; and a swatch of material; wherein the purse shell comprising a base and a two sides; wherein the two sides of the shell have one or more material apertures, wherein the plurality of sides have one or more strap connectors; wherein the swatch of material has one or more edges; wherein the swatch of material is placed under the base of the purse shell and wrapped around the two sides of the purse shell and the one or more edges of the swatch of material are tied to the one or more material apertures, such that the swatch of material substantially covers the purse shell and a purse interior cavity is formed. Preferably, the purse device of further comprises a strap; and a purse insert; wherein the purse insert is placed within the purse interior cavity, such that the purse insert matingly fits within the purse shell; wherein the strap is removeably connected to the one or more strap connectors, such that the modular purse device may be carried by a user via the strap. Preferably, the insert has a four sides, a base, and two closure flaps; wherein at least the four of sides and the base of the purse insert are substantially covered by the swatch of material; wherein the two flaps each have one or more connectors; wherein the one or more connectors removeably engage with each other to substantially close the purse insert. Preferably, the base of the purse shell has one or more material connectors; and wherein the swatch of material engages with the one or more material connectors such that the swatch of material is interconnected with the base of the purse shell. Preferably, the purse insert is further comprised of one or more interior pockets; wherein the one or more interior pockets are configured to hold a plurality of contents of a modular purse device.

It is an object of the present invention to overcome the limitations of the prior art.

It is an object of the present invention to provide a modular purse that includes a swatch of material as a cover and an optional insert. The swatch of material, which is preferably a rectangular scarf, is attached to the purse shell at four holes on the sides of the purse shell. The scarf is then tied off, or to itself, to cinch the scarf over the purse shell and make a unique, customizable, and fashionable purse.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

Figure 1:
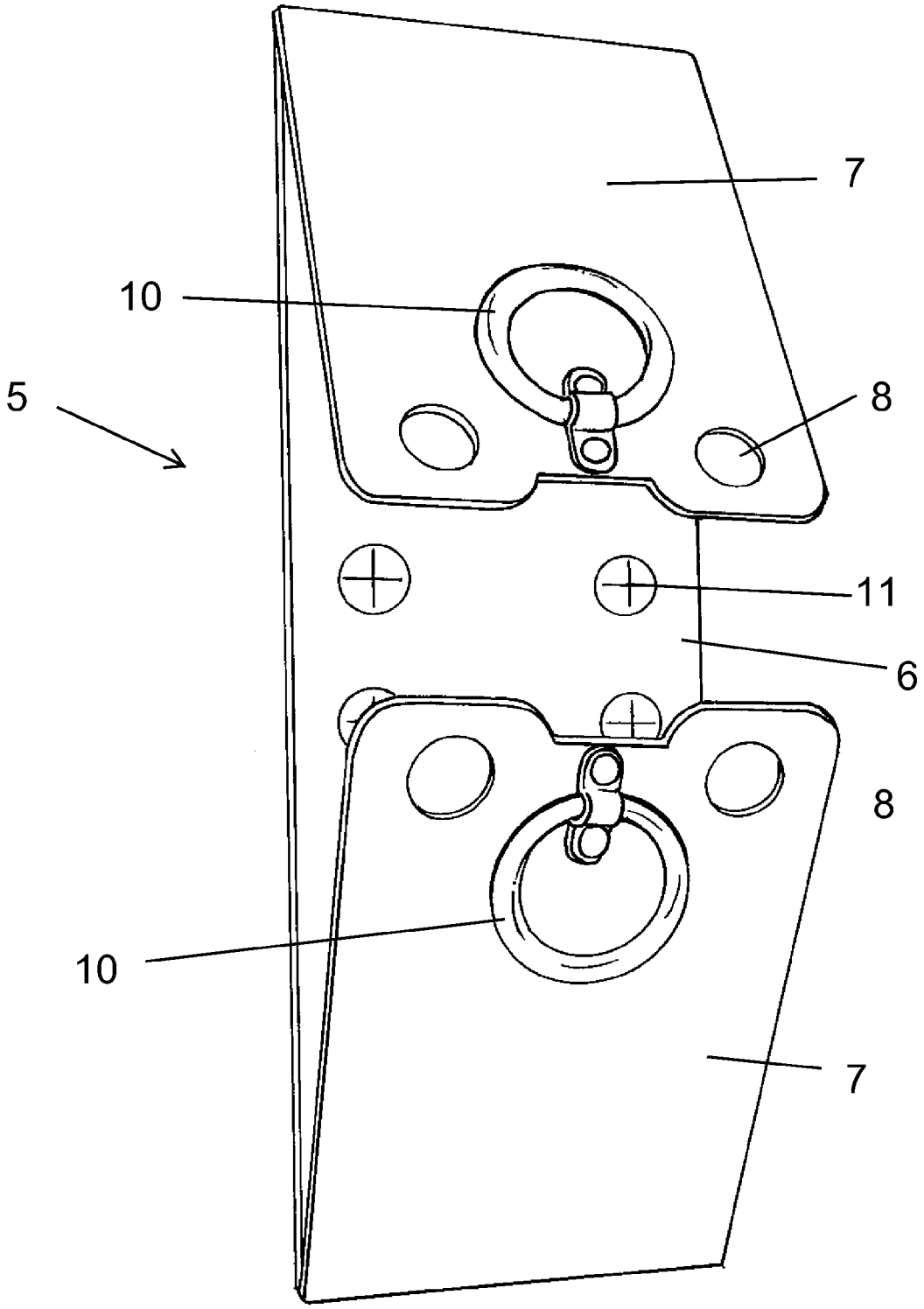
FIG. 1 is an illustration of a top perspective view of one embodiment of the purse shell.

FIG. 1 is an illustration of a top perspective view of one embodiment of the purse shell. As shown in FIG. 1, the purse shell 5 preferably has a base 6, two sides 7, a plurality of side apertures 8 (or holes), strap connectors 10, and material connectors 11. The purse shell 5, preferably is collapsible, for easier storage and shipping. As shown in FIG. 1, the strap connectors 10 are preferably metal rings and are configured to engage with a connector on a purse strap. The strap connectors 10 may be made out of any material and may have any shape that allows it to connect to a strap. The purse shell 5 is preferably made of plastic, but could be made out of lightweight, but sturdy wood, metal, or any material without deviating from the scope of the invention. The sides 7 are configured to unfold and hold a bracket shape. This open bracket shape forms the interior cavity of the purse device.

Figure 2:
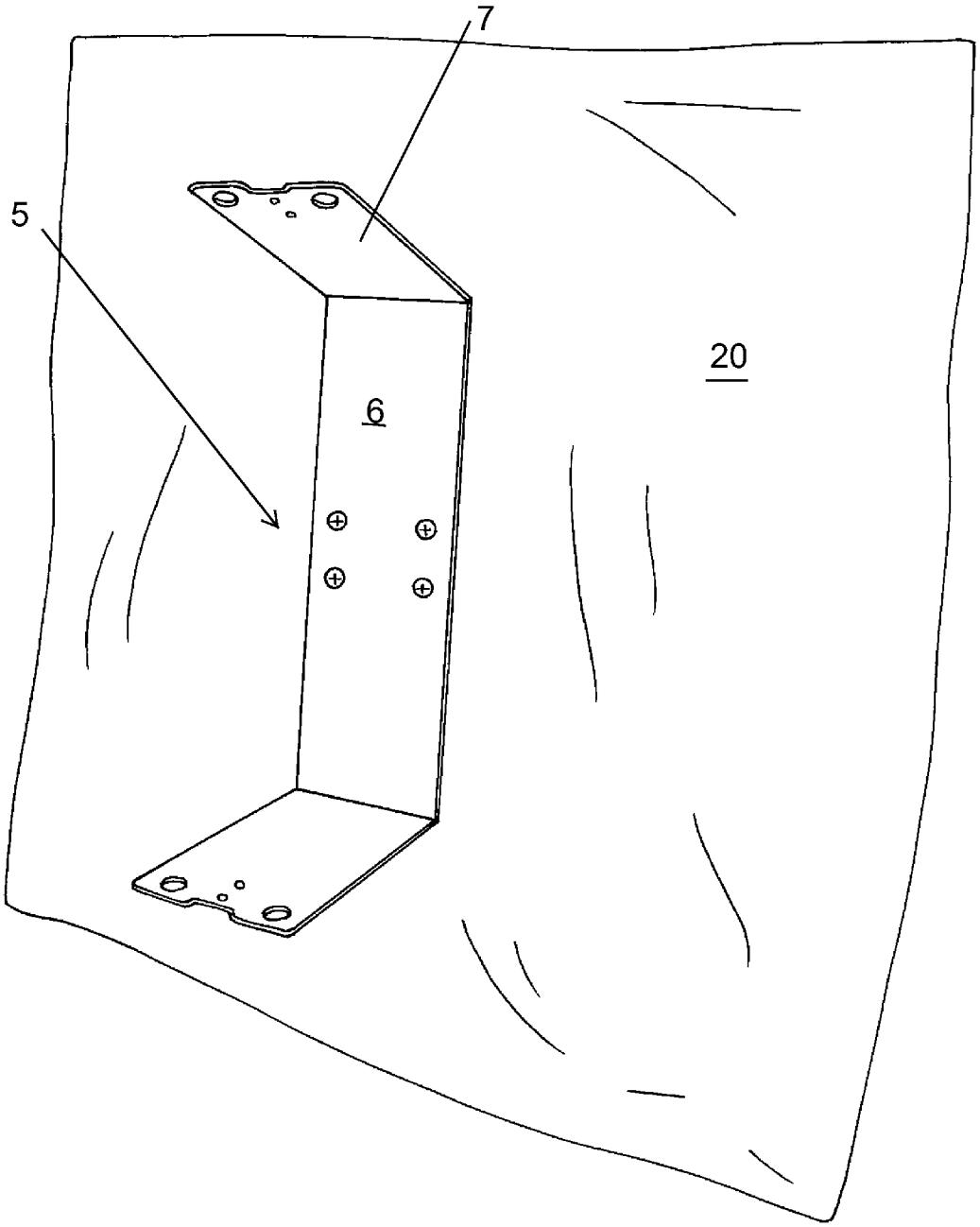
FIG. 2 is an illustration of a perspective view of one embodiment of the purse shell and swatch of material.

FIG. 2 is an illustration of a perspective view of one embodiment of the purse shell and swatch of material. As shown in FIG. 2, to assemble the present invention, the purse shell 5 is preferably placed on top of the flexible swatch of material 20. The swatch of material 20 is then interconnected with and wrapped around the purse shell such that the swatch of material becomes the cover of the purse that is created. FIG. 2 shows how the sides 7 preferably hold a bracket shape.

The material in the swatch of material may be any natural, artificial, or synthetic material, fiber, or fabric, including, but not limited to, leather, cotton, wool, hair, fur, silk, hemp, pulp, or other plant fibers, carpet, denim, plastic, rayon, acetate, nylon, modacrylic, olefin, acrylic, polyester, carbon fiber, Vinyon, Saran, Spandex, Vinalon, Aramids, Modal, Dyneema/Spectra, Polybenzimidazole fiber, Sulfar, Lyocell, PLA, M-5 (PIPD fiber), Orlon, Zylon (PBO fiber), Vectran (TLCP fiber), Derclon, acrylonitrile rubber, glass fiber, metallic fiber, composite fiber, and/or any combination thereof.

Preferably, the swatch of material is rectangular, as shown, but it may be any shape without deviating from the scope of the invention. Preferably, the swatch of material is a recycled garment, such as, for example, an old T-Shirt, pajamas, or bridesmaid/prom dress. But, a new swatch of material may be used without deviating from the scope of the invention.

Figure 3:
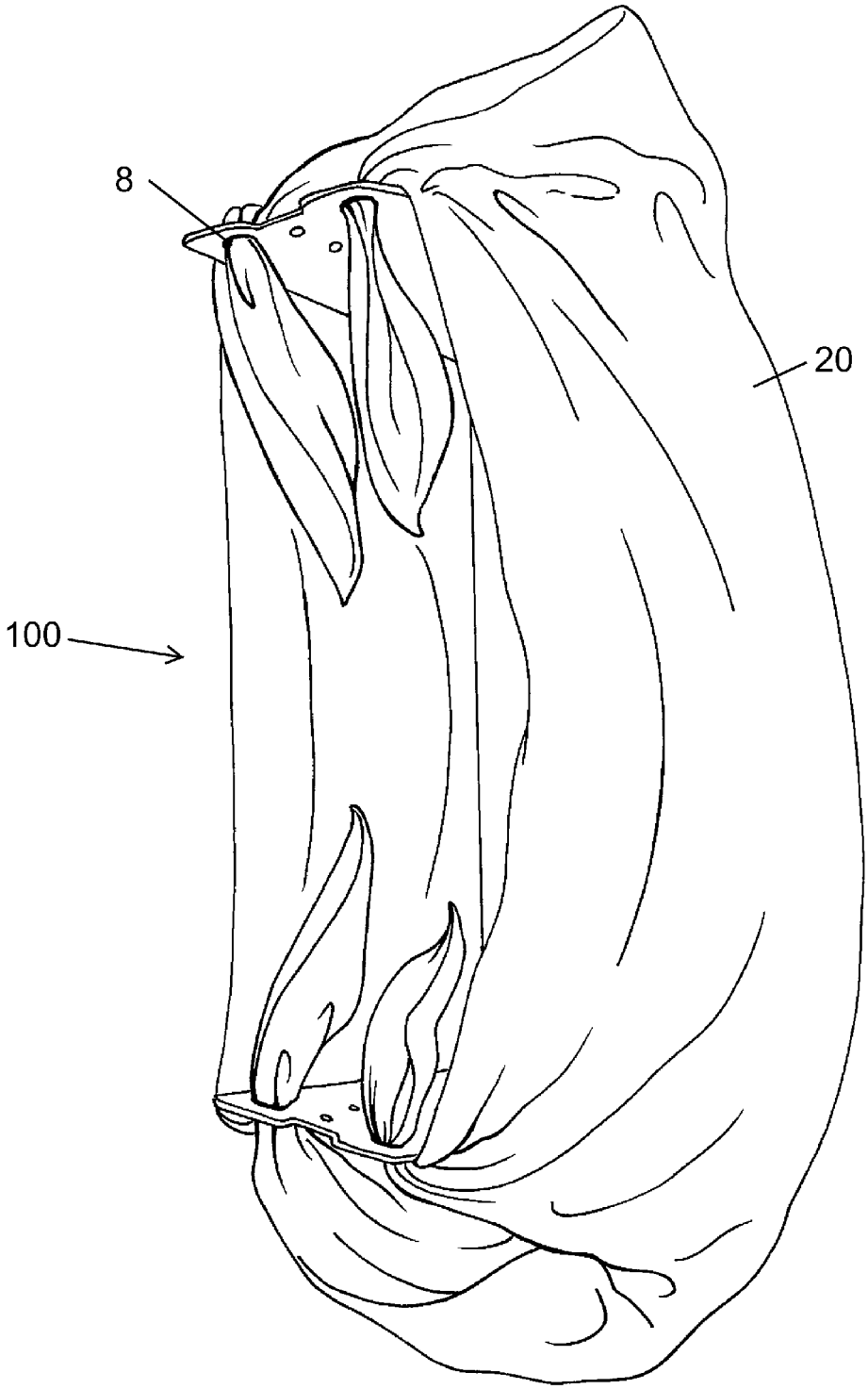
FIG. 3 is an illustration of a perspective view of one embodiment of the purse shell with the swatch of material engaging with the side apertures.

FIG. 3 is an illustration of a perspective view of one embodiment of the purse shell with the swatch of material engaging with the side apertures. As shown in FIG. 3, the corners of the swatch of material 20 are drawn through the apertures 8. FIG. 3 also shows that after the edges (typically the corners) of the swatch of material 20 are pulled through the desired number of apertures 8 of purse shell 5, purse 100 is substantially formed. Although apertures 8, as shown are preferably round holes, they may be of any shape or size, and may even be an external connection device, such as a loop or ring.

Figure 4:
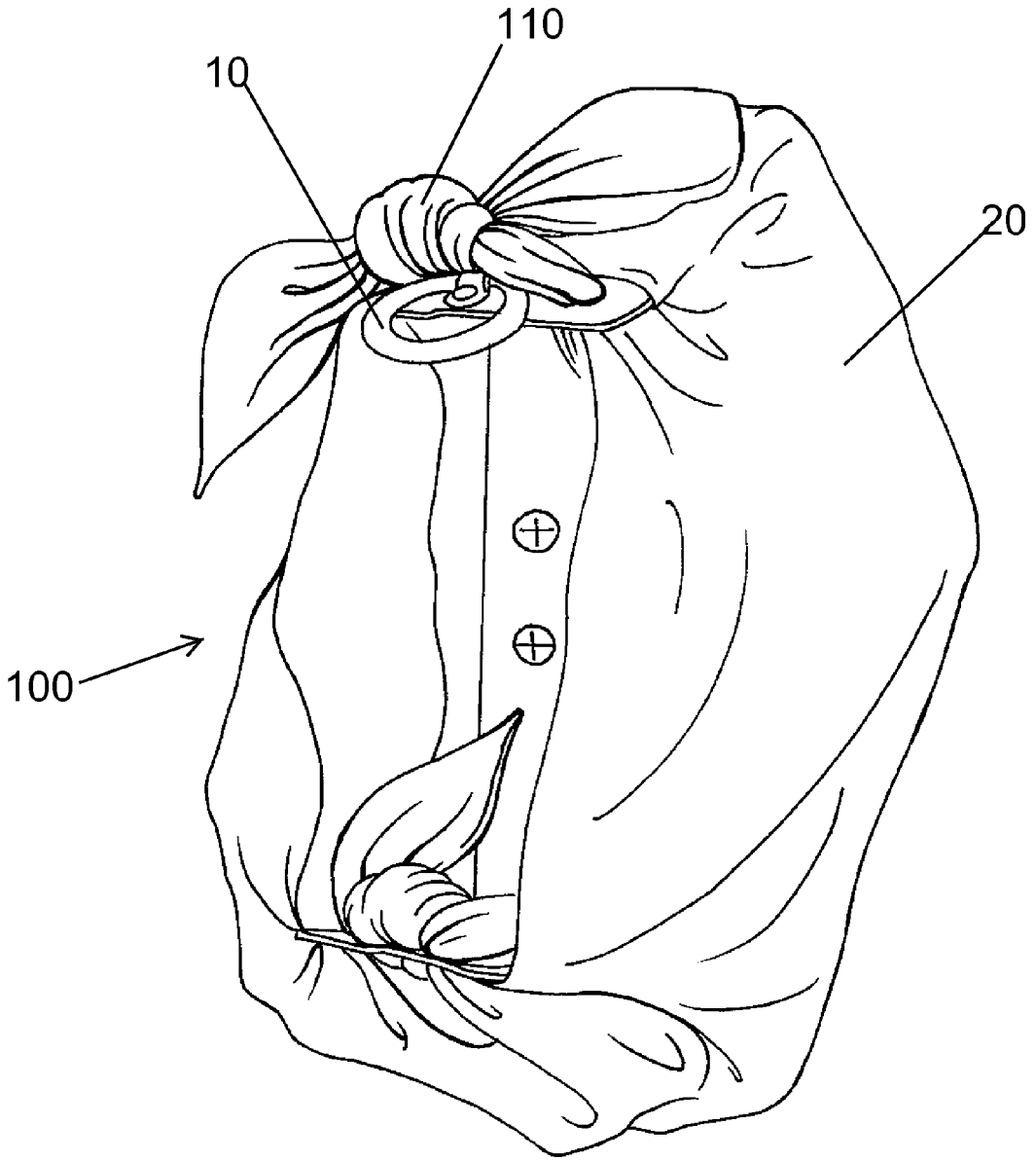
FIG. 4 is an illustration of a perspective view of one embodiment of the purse device showing the swatch of material covering the purse shell.

FIG. 4 is an illustration of a perspective view of one embodiment of the purse device showing the swatch of material covering the purse shell. As shown in FIG. 4, the swatch of material 20 is tightened or cinched via knot 110 around the purse shell 5. There is no limit to the type of knots that may be used to cinch the swatch of material to the purse shell 5. Additionally, the strap connectors 10 may be accessible (as shown) or hidden without deviating from the scope of the invention. If the strap connectors 10 are tucked under swatch of material 20, then purse 100 resembles a clutch purse.

Figure 5:
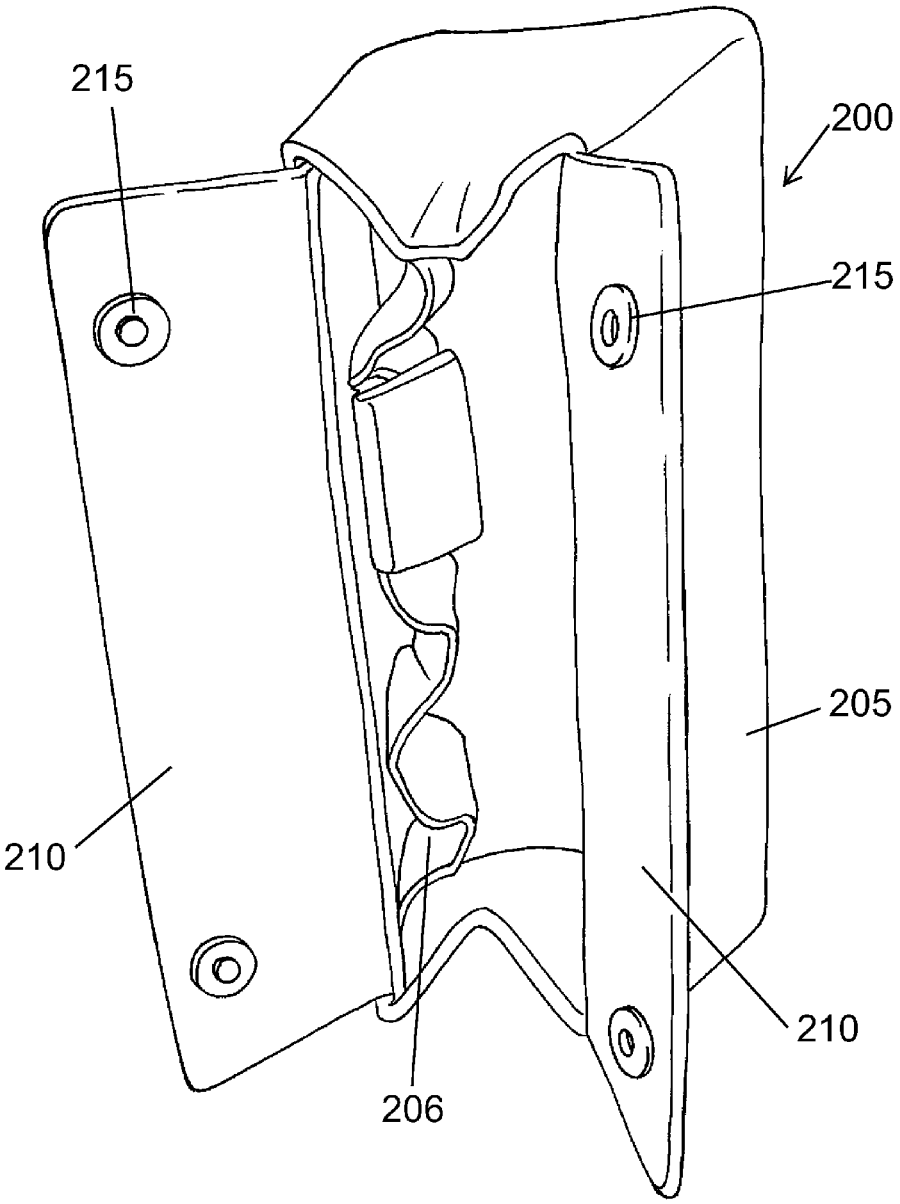
FIG. 5 is an illustration of a perspective view of one embodiment of the purse insert.

FIG. 5 is an illustration of a perspective view of one embodiment of the purse insert. As shown in FIG. 5, the purse 100 preferably has a removable purse insert 200 (also called an organizer). Purse insert 200 is preferably comprised of a main body 205, interior pockets 206 or organizing pockets, closure flaps 210, and connectors 215 (also called clasps 215). Connectors 215 preferably interconnect to allow the user to close the purse that is created. The main body 205, as shown, preferably has four sides and a base and is configured to matingly engage with the purse shell 5. The connectors 215 are preferably friction or magnetic snaps that can connect to each other and, in some circumstances, may connect through one or more layers of the swatch of material. In this way the entire insert 200 is covered by the material 20. The connectors 215 may be any closure device, including, but not limited to, hook and loop material, button, snap, magnetic clasp, pin, hook, or friction snap, without deviating from the scope of the invention. The interior pockets 206 are preferably configured to hold in an organized manner the items, stuff, and/or contents that a user would put in a purse. The purse insert 200 is preferably made from a soft fiber or woven plastic material that is relatively flexible compared to the more rigid shell 5.

Figure 6:
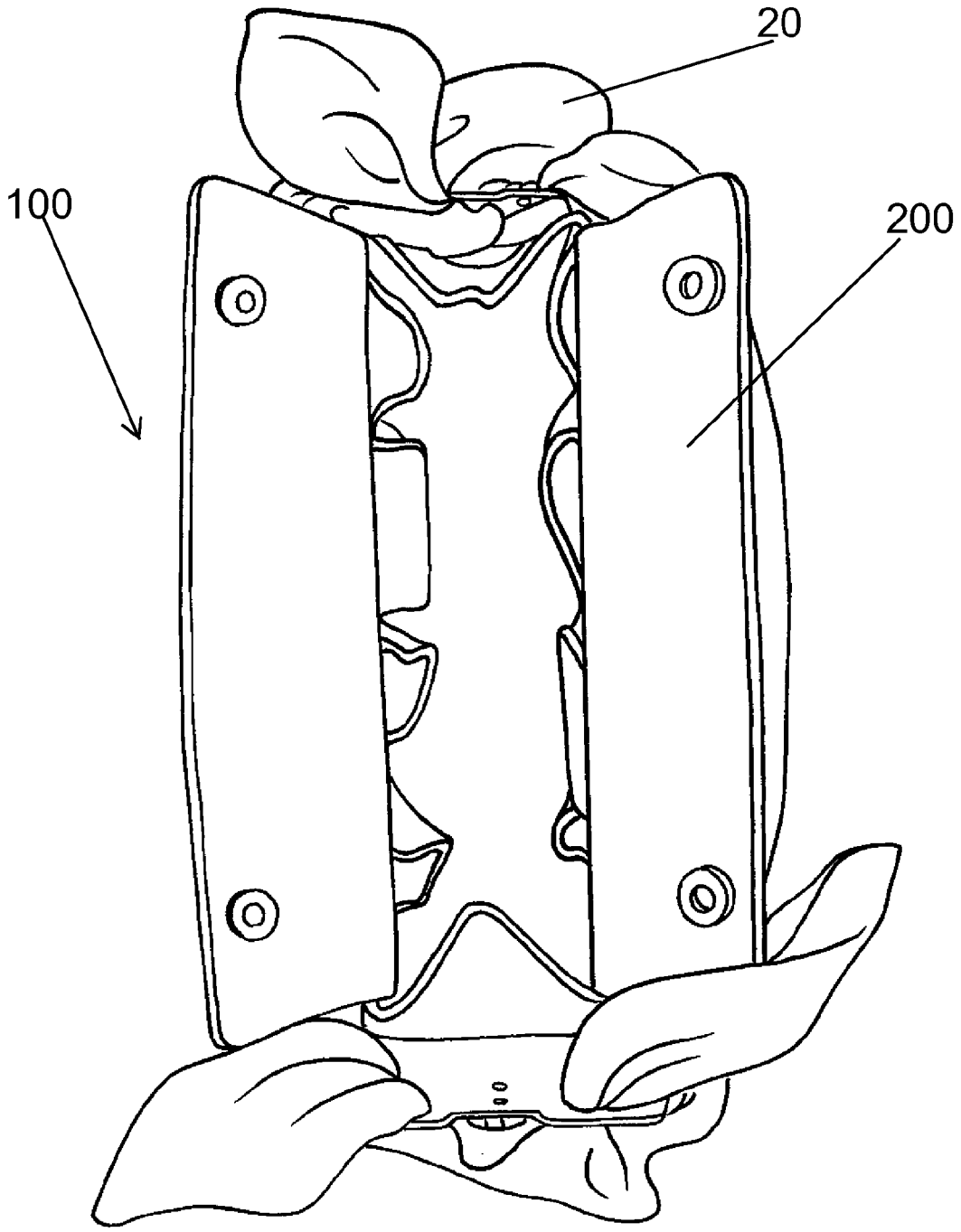
FIG. 6 is an illustration of a perspective view of one embodiment of the purse device with the purse shell in the interior cavity of the purse device.

FIG. 6 is an illustration of a perspective view of one embodiment of the purse device with the purse shell in the interior cavity of the purse device. As shown in FIG. 6, the purse insert 200 preferably matingly fits within the purse shell 5 and swatch of material 20 to provide additional structure to the purse 100. Preferably, the purse insert 200 has the same geometric or organic structure as the purse insert 5 to allow a mating engagement.

Figure 7:
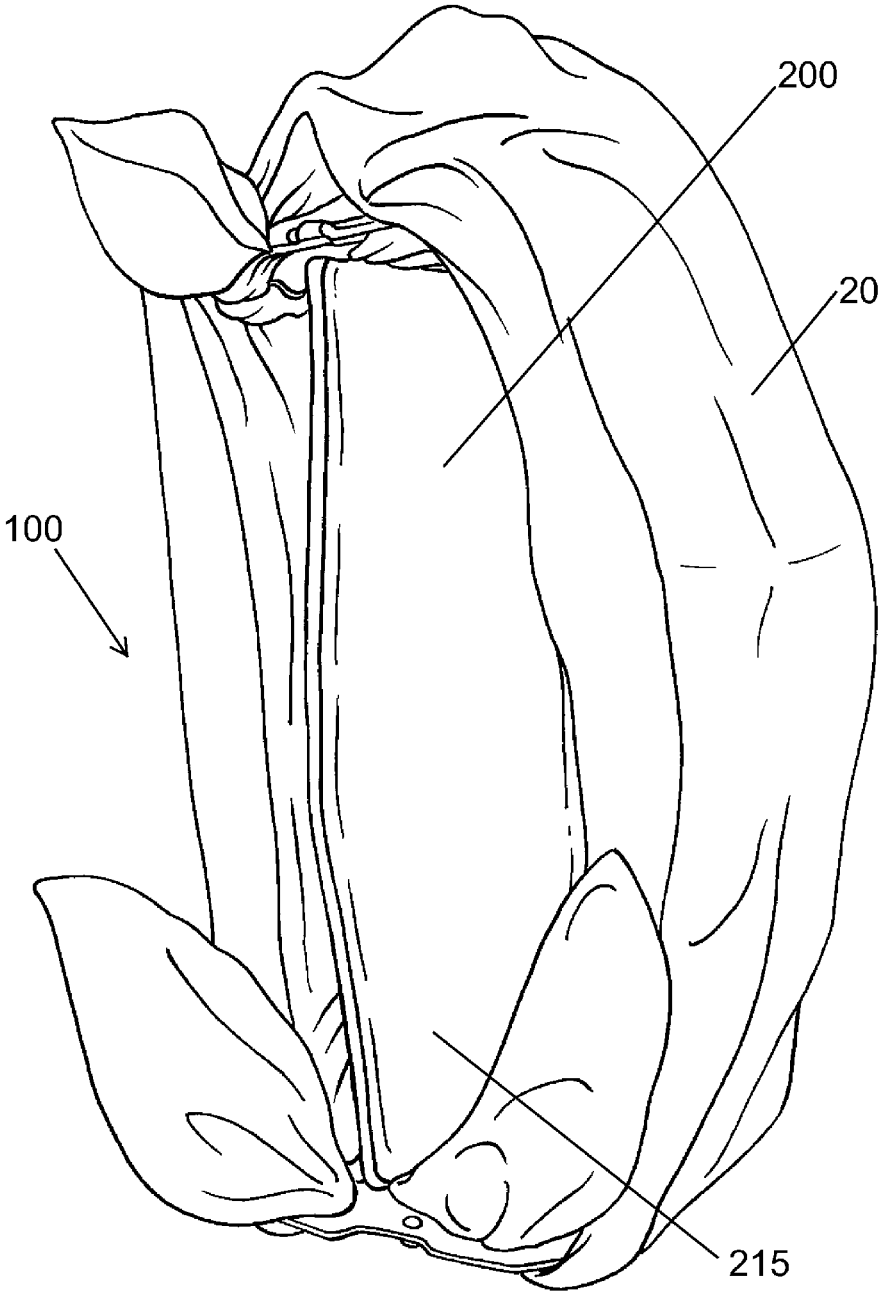
FIG. 7 is an illustration of a perspective view of one embodiment of the purse device showing the purse insert closed.

FIG. 7 is an illustration of a perspective view of one embodiment of the purse device showing the purse insert closed. FIG. 7 shows one way to engage the connectors 215 to close the top of purse insert 200.

Figure 8:
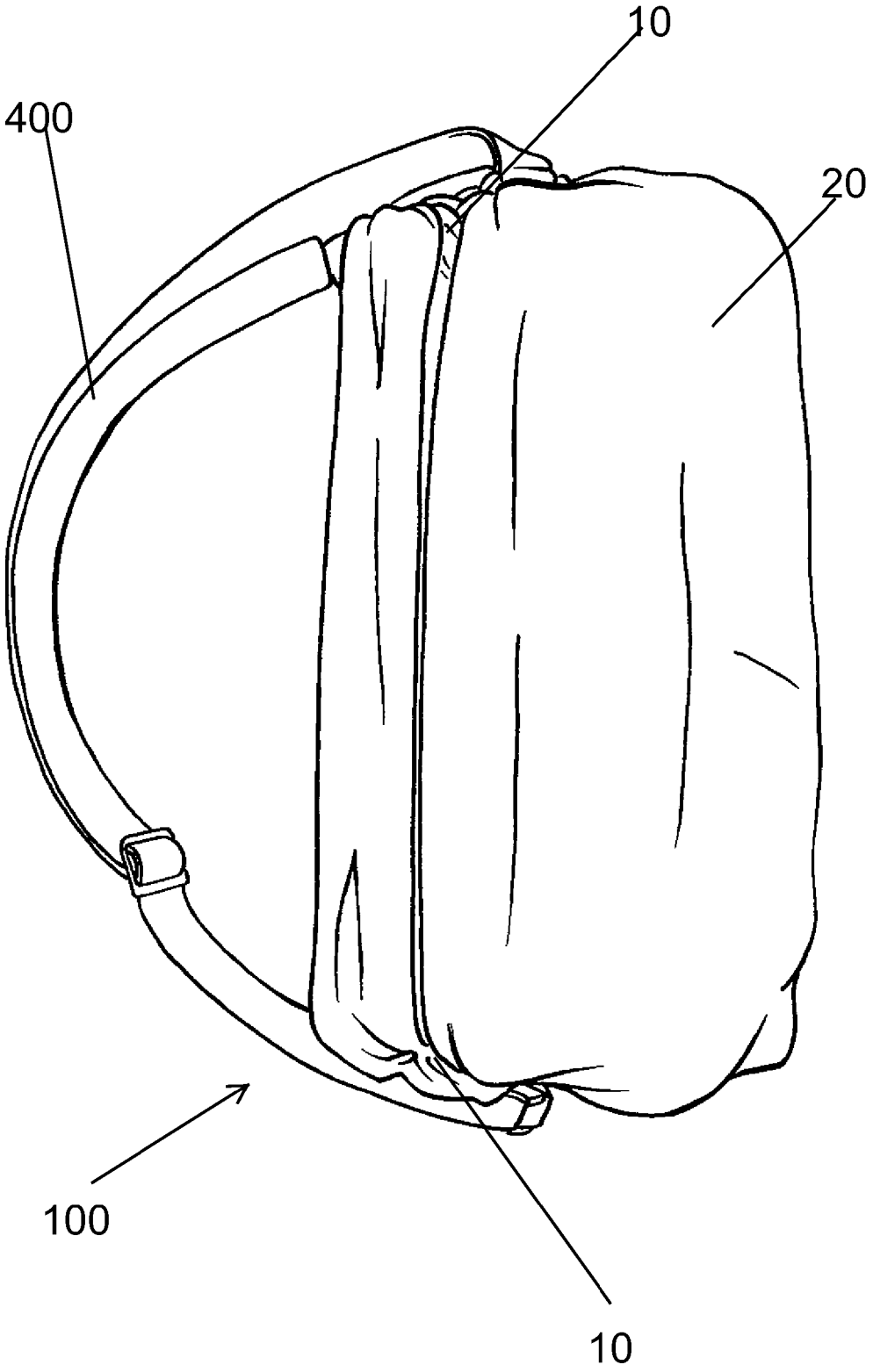
FIG. 8 is an illustration of a perspective view of one embodiment of the purse device showing the swatch of material covering the closure flaps.

FIG. 8 is an illustration of a perspective view of one embodiment of the purse device showing the swatch of material covering the closure flaps. As shown in FIG. 8, a purse strap 400 is preferably attached to the two purse strap connectors 10. The flaps 210 are preferably covered by the swatch of material 20. Preferably, the entire purse 100 is completely or at least substantially covered by swatch of material 20.

Figure 9:
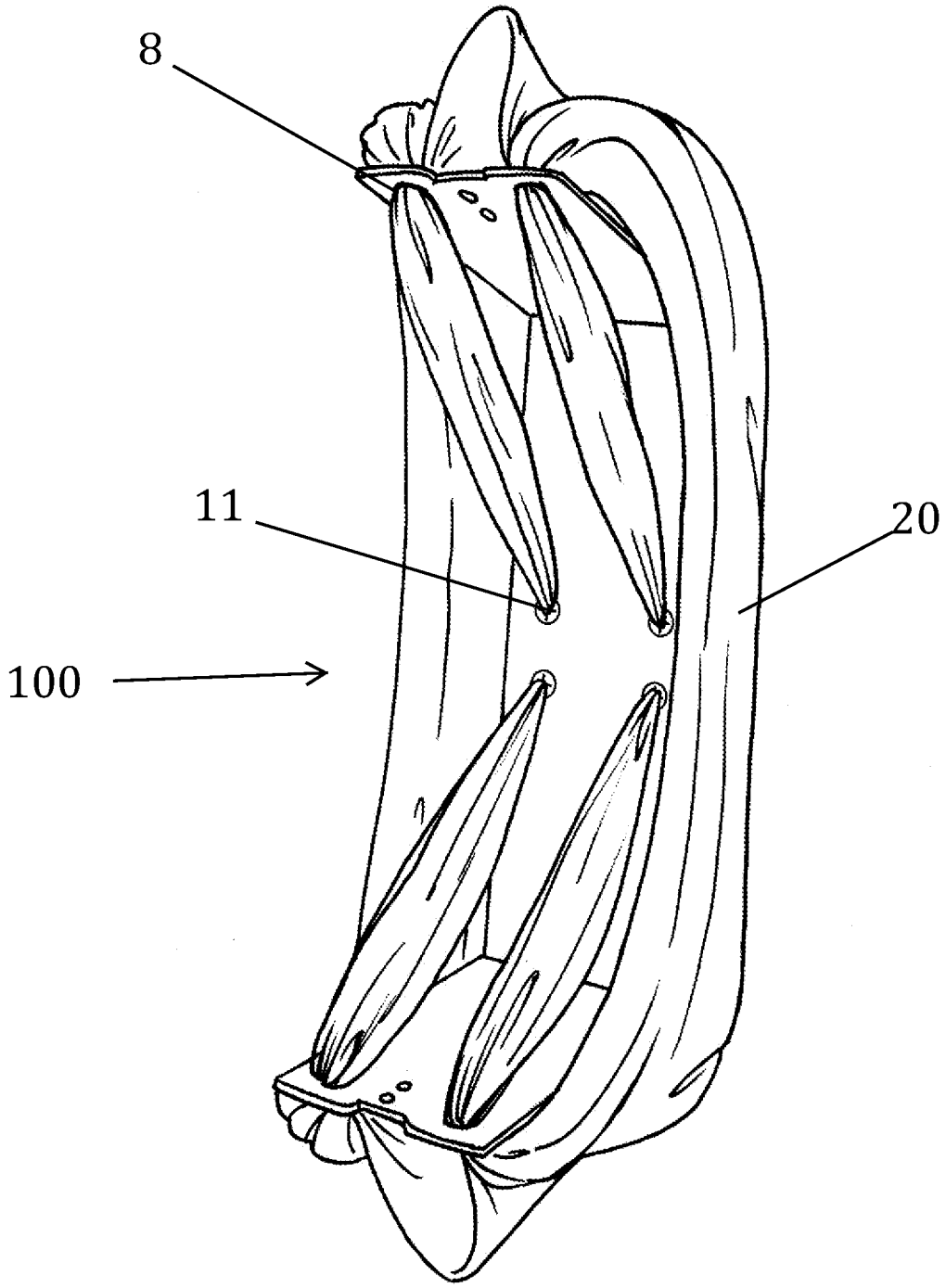
FIG. 9 is an illustration of a perspective view of one embodiment of the purse shell with the swatch of material engaging with the side apertures and the material connectors.

FIG. 9 is an illustration of a perspective view of one embodiment of the purse shell with the swatch of material engaging with the side apertures and the material connectors. As shown in FIG. 9, the corners of the swatch of material 20 are drawn through the apertures 8 and then engaged with material connectors 11. FIG. 9 also shows that after the edges (typically the corners) of the swatch of material 20 are pulled through the desired number of apertures 8 of purse shell 5, and engaged with the material connectors 11, purse 100 is substantially formed. In this manner the user does not need to knot or tie the swatch of material 20 to the apertures 8. Although apertures 8, as shown are preferably round holes, they may be of any shape or size, and may even be an external connection device, such as a loop or ring. Although material connectors 11 are shown engaging with swatch of material 20 through friction, it should be understood that material connectors 11 may be any type of connector, including, but not limited to, snap, adhesive, magnetic, clip, adapter, bond, clamp, connection, connector, coupling, fastener, joint, junction, link, and tie.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and that is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent to the public, regardless of whether it is or is not recited in the claims.

What is claimed is:

1. A modular purse device comprising:

a purse shell;

a swatch of material;

a purse insert; and a strap;

wherein said purse shell is comprised of a base and a two sides;

wherein said two sides of said shell have one or more material apertures, wherein said plurality of sides have one or more strap connectors;

wherein said swatch of material has one or more edges;

wherein said swatch of material is placed under said base of said purse shell and wrapped around said two sides of said purse shell and said one or more edges of said swatch of material are tied to said one or more material apertures, such that said swatch of material substantially covers said purse shell and a purse interior cavity is formed;

wherein said purse insert is placed within said purse interior cavity, such that said purse insert matingly fits within said purse shell;

wherein said purse insert has a four sides, a base, and two closure flaps;

wherein said four sides and said base of said purse insert are substantially covered by said swatch of material;

wherein said two flaps each have one or more connectors;

wherein said one or more connectors of said flaps removeably engage with each other to substantially close said purse insert; and wherein said strap is removeably connected to said one or more strap connectors, such that said modular purse device may be carried by a user via said strap.

2. The modular purse device of claim 1, wherein said purse insert is further comprised of one or more interior pockets; and wherein said one or more interior pockets are configured to hold a plurality of contents of a modular purse device.

3. The modular purse device of claim 2, wherein said base of said purse shell has one or more material connectors; and wherein said swatch of material engages with said one or more material connectors such that said swatch of material is interconnected with said base of said purse shell.

4. A modular purse device, comprising:

a purse shell; and a swatch of material;

wherein said swatch of material is removeably interconnected to said purse shell;

wherein said purse shell is comprised of a base and a plurality of sides;

wherein said plurality of sides have one or more material apertures, such that said swatch of material is removeably interconnected to said purse shell via said one or more material apertures;

wherein said plurality of sides have one or more strap connectors;

wherein said swatch of material has one or more edges; and wherein said swatch of material is placed under said base of said purse shell and wrapped around said plurality of sides of said purse shell and tied to said one or more material apertures, such that said swatch of material substantially covers said purse shell and a purse interior cavity is formed.

5. The modular purse device of claim 4, further comprising:

a purse insert, wherein said purse insert is placed within said purse interior cavity, such that said purse insert matingly fits within said purse shell.

6. The modular purse device of claim 5, wherein said purse insert has a plurality of sides, a base, and a closure portion; and wherein at least said plurality of sides and said base of said purse insert are substantially covered by said swatch of material.

7. The modular purse device of claim 6, wherein said base of said purse shell has one or more material connectors; and wherein said swatch of material engages with said one or more material connectors, such that said swatch of material is interconnected with said base of said purse shell.

8. The modular purse device of claim 7, wherein said closure portion of said purse insert comprises two flaps;

wherein said two flaps each have one or more connectors; and wherein said one or more connectors removeably engage with each other to substantially close said purse insert.

9. The modular purse device of claim 8, wherein said purse insert is further comprised of one or more interior pockets;

wherein said one or more interior pockets are configured to hold a plurality of contents of a modular purse device.

10. The modular purse device of claim 9, further comprising a strap;

wherein said strap is removeably connected to said one or more strap connectors, such that said modular purse device may be carried by a user via said strap.

11. A modular purse device, comprising:

a purse shell;

a swatch of material;

a strap; and a purse insert;

wherein said purse shell is comprised of a base and a two sides;

wherein said two sides of said shell have one or more material apertures;

wherein said plurality of sides have one or more strap connectors;

wherein said swatch of material has one or more edges;

wherein said swatch of material is placed under said base of said purse shell and wrapped around said two sides of said purse shell and said one or more edges of said swatch of material are tied to said one or more material apertures, such that said swatch of material substantially covers said purse shell and a purse interior cavity is formed;

wherein said purse insert is placed within said purse interior cavity, such that said purse insert matingly fits within said purse shell; and wherein said strap is removeably connected to said one or more strap connectors, such that said modular purse device may be carried by a user via said strap.

12. The modular purse device of claim 11, wherein said purse insert has a four sides, a base, and two closure flaps;

wherein said four of sides and said base of said purse insert are substantially covered by said swatch of material;

wherein said two flaps each have one or more connectors; and wherein said one or more connectors removeably engage with each other to substantially close said purse insert.

13. The modular purse device of claim 12, wherein said base of said purse shell has one or more material connectors; and wherein said swatch of material engages with said one or more material connectors, such that said swatch of material is interconnected with said base of said purse shell.

14. The modular purse device of claim 12, wherein said purse insert is further comprised of one or more interior pockets; and wherein said one or more interior pockets are configured to hold a plurality of contents of a modular purse device.

* * * * *